United States Patent [19]

Litzberg

[11] Patent Number: 4,464,909

[45] Date of Patent: Aug. 14, 1984

[54] METHOD OF RECOVERING THERMAL ENERGY BY HEAT PUMP FROM SEA WATER AND COMPARABLE WATER MASSES

[75] Inventor: Lennart K. Litzberg, Stockholm, Sweden

[73] Assignee: Skandinavisk Installationssamordning AB (SISAM AB), Stockholm, Sweden

[21] Appl. No.: 477,636

[22] Filed: Mar. 21, 1983

[51] Int. Cl.[3] ..... F24D 21/04

[52] U.S. Cl. ..... 62/260; 62/238.6

[58] Field of Search ..... 165/45; 62/260, 238.6

[56] References Cited

U.S. PATENT DOCUMENTS 4,091,636 5/1978 Margen ..... 62/260 X

FOREIGN PATENT DOCUMENTS 2609113 9/1977 Fed. Rep. of Germany ..... 62/260

*Primary Examiner*—Allen M. Ostrager

*Attorney, Agent, or Firm*—Sherman & Shalloway

[57] ABSTRACT

The invention relates to a method of recovering thermal energy from sea water and comparable water masses. Sea water is supplied in a constant or variable flow to a heat exchanger (3) and returned to the sea. A heat carrying medium is pumped simultaneously through the heat exchanger (3) and a supply conduit (7,11) to an evaporator for a per se known heat pump (8) and through a return conduit (12,9) again to the heat exchanger (3). The medium is pumped in a flow exceeding the flow through the evaporator, and a part of the medium is directed from the supply conduit (7) past (10) the evaporator and to the return conduit (9). The sea water flow is of a size at least equal to the medium flow.

3 Claims, 2 Drawing Figures

Figure 1:
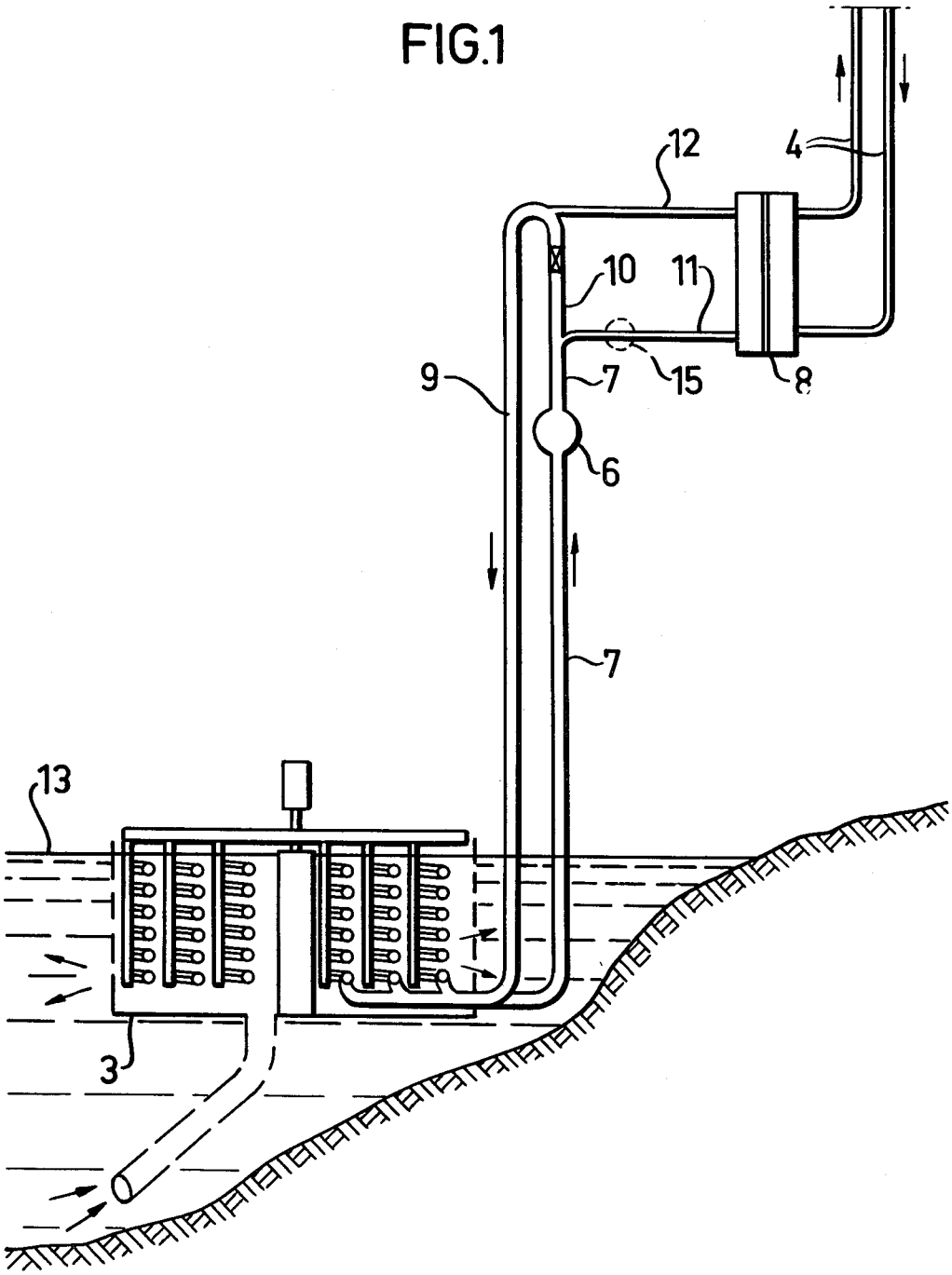

METHOD OF RECOVERING THERMAL ENERGY BY HEAT PUMP FROM SEA WATER AND COMPARABLE WATER MASSES

This invention relates to a method of recovering thermal energy from sea water and similar water masses.

In view of the risk of reduced availability, both periodically and on the long run, of energy forms available today, especially of oil, and in connection therewith of the high and ever increasing prices for available energy forms, it has become increasingly attractive, especially for heating purposes, to try to recover the low-grade thermal energy stored in nature. In addition to utilizing directly the solar energy, it is tried, especially on northern latitudes, to make use, a. o. for heating purposes, of the heat found in the air, earth and water by means of heat pump technology. On northern latitudes, unfortunately, the availability of higher air temperatures rarely coincides with the demand of heating and, therefore, the method of recovering the thermal energy of the air has proved economically less justifiable in connection with heat pump technology.

Methods have been developed to try to utilize the earth heat, which on unfrozen depth does not drop below ±0° C. The thermal energy received and stored in earth during the "summer half-year" can be utilized during the "winter half-year". The thermal energy in principle is utilized in that hoses or conduits of very great length are laid out on a suitable depth, and a heat carrier (for example water and glycol) is circulated through the hose in order to take up the thermal energy stored in earth and deliver it to the evaporator in a heat pump.

A parallel or alternative method to these methods is to recover, instead, during the winter half-year the thermal energy stored in the sea, lakes and water courses during the warmer period of the year. During the colder periods of the year, the heat, relatively seen, is constant at the depth significant for the water mass concerned. The thermal energy is practice also in this case is recovered by means of hoses or pipes. Which are laid out on the sea bottom, with a heat carrier, which delivers the thermal energy taken-up to the evaporator of the heat pump.

Irrespective of the purely technical difficulties involved with the manufacture and installation, in addition to the large ground and, respectively, bottom areas required, the two last mentioned methods also give rise to great operation-technical problems.

The earth mass about the conduit, as mentioned, holds a temperature slightly above ±0° C., normally +1° C. to +2° C. Heat being transported away with the heat carrier, the temperature in the surrounding earth mass drops all the time. Temperatures below ±0° C. are obtained, which implies ice formation about the conduit, resulting in a deteriorated efficiency degree.

A corresponding situation can be stated for conduits laid in the sea. During the "winter half-year" (with time shiftings depending on climate and latitude) the sea water holds a temperature of about +1° C. to +2° C. Due to the fact, that the water about the conduit laid on the bottom can be standing still more or less, the temperature will drop when the thermal energy is transported away and ice forms on the outer surface of the conduit. This implies, that the conduit is insulated and, as a consequence, its heat transmission coefficient, and thereby the efficiency degree of the installation, is deteriorated.

Conduits, besides, are subject to external soiling a.o. by algal growth, which also reduces the efficiency degree.

The present invention, as it is defined in the characterizing clauses of the claims, renders it possible, in combination with heat pump technology, to continuously recover the thermal energy of the sea water or comparable water masses during the colder period of the year and to choose such dimensioning data, that sea water with a temperature close to the freezing point can be utilized with full installed heat pump capacity without being obstructed by ice formation.

This implies, that full energy tap can go on even during the coldest period of the year, for example in January, February and March.

Figure 2:
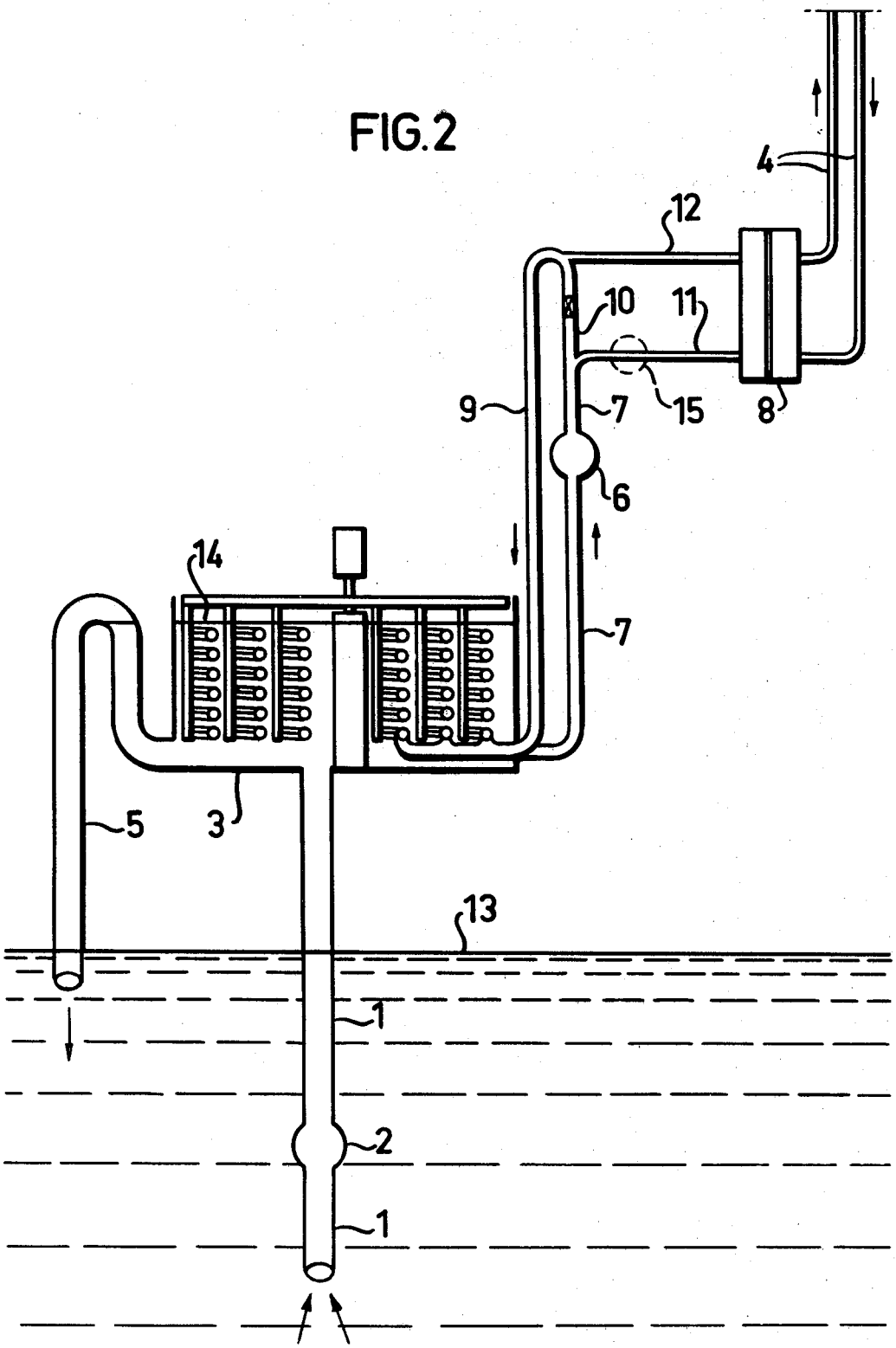

The invention is described in greater detail in the following by way of an embodiment, with reference to the drawings, in which FIG. 1 very schematically shows an installation for carrying out the invention, and FIG. 2 shows another design of the installation.

A heat exchanger 3 is positioned directly into the sea water (FIG. 1). A heat carrier, for example a mixture of water and glycol, is pumped by a pump 6 from the heat exchanger 3 via the conduit 7 and 11 to the evaporator of a heat pump 8, which is known per se and here not described in detail. From the pump the heat carrier is returned via the conduit 9 and 12 to the heat exchanger 3. A shunt conduit 10 interconnects the conduits 7 and 9, so that the evaporator is by-passed. 4 designates in general the conduits, which connect the condenser of the heat pump to the heating system or systems served by the heat pump 13 designates the surface of the sea water. The heat exchanger 3, in which the heat of the sea water is taken up by the heat carrier, can preferably be of the type where the heat carrier flows in pipe coils concentrically arranged in each other, between which sea water flows. By means of brushes supported on arms, which are mounted pivotally about an axle located in the centre line common to the coils, it is possible to maintain the heat exchanging surfaces of the coils clean from impurities of the sea water, and to prevent the growth of algae and other water plants thereon, at the same time as the sea water is forced to flow along and between the coils. The brushes are effected to rotate by a drive motor, for example electric or hydraulic, which in the latter case can be driven by the pump-operated heat carrier system.

The heat exchanger is provided at its bottom with an inlet opening for sea water. This opening can be connected to a conduit, which opens in a place at a depth suitable for utilizing in wintertime the highest thermal capacity of the water. The principle of such a heat exchanger is described in SE-PS No. 7706927-6 and in patent application SE No. 7908805-0.

When it is deemed more suitable to position the heat exchanger in a place other than in the sea (FIG. 2), the sea water can be pumped through a conduit 1 by means of a pump 2 to a heat exchanger 3 and be returned to the sea through a conduit 5. The inlet of the conduit 1 in the sea is positioned in a place where during the winter half-year the highest temperature prevails. The outlet of the conduit 5 in principle can be positioned in any place, but at such a distance from the inlet that the water mass about the inlet is not affected by the temperature of the outlet water. In the same way as described above, a heat carrier is pumped by a pump 6 from the heat exchanger 3 via conduits 7 and 11 to the evaporator of a heat pump. From this pump the heat carrier is returned via conduits 9 and 12 to the heat exchanger 3. A shunt conduit 10 interconnects the conduits 7 and 9 so that the evaporator is by-passed. 4 designates generally the conduits, which connect the condenser of the heat pump to the heating system or systems served by the heat pump. 13 designates the surface of the sea water, and 14 designates the sea water surface in the interior of the heat exchanger.

A location of the exchanger when sea water is passed through it by a pump can be exemplified as follows.

During the cold period of the year, sea water, for example with a temperature of +2° C., is pumped through the conduit 1. The sea water, which is pumped at a relatively large flow, delivers heat in the heat exchanger 3 to the heat carrier and flows out of the exchanger via the conduit 5 at a temperature of +1.5° C. The heat carrier, which has a slightly smaller flow, arrives at the heat exchanger 3 at a temperature of −1° C., takes up heat from the sea water in the heat exchanger and, according to the example, thus flows out of the heat exchanger at a temperature higher by one degree, i.e. at ±0° C. The heat carrier holds this temperature when it arrives at the evaporator surfaces of the heat pump 8 through the conduit 11. In the evaporator, heat is delivered (assumed evaporation temperature −7° C.), and the heat carrier leaves the evaporator via the conduit 12 at a temperature of −4° C. The flow through the evaporator is about one quarter of the heat carrier flow through the heat exchanger, and this part of the heat carrier, at −4° C., is mixed after the shunt 10 with the remaining shunted part of the heat carrier, at 0° C., in the conduit 9. Therefore, the temperature of the heat carrier arriving at the heat exchanger 3 is the aforementioned temperature of −1° C. Due to the fact, that according to the invention sea water with forced and large flow is used, in combination with a carrier, which also has a large flow, a part of which is shunted past the evaporator of the heat pump, it is possible to approach the freezing point without ice forming on the heat exchanger surfaces. In the shunt conduit 10 preferably a shunt valve is provided, through which the heat supply to the evaporator can be controlled and preferably is maintained constant or is varied according to load demand, depending on the temperatures of the sea water, and therewith of the heat carrier, varying within certain limits.

When the conduits 11 and 12 have great length, for example for construction-technical reasons, the flow resistance in these conduits will be too great for rendering controlled shunting in the conduit 10 by only one shunt valve possible. In order in such cases to bring about a controlled shunting, a pump is provided, for example in the conduit 11, as indicated by a dashed line at 15 in FIG. 2, by means of which pump the flow through the conduits 11,12 is controlled.

It is possible within the scope of the invention even to permit a controlled limited ice formation in the heat exchanger 3, depending on external conditions, water temperature and types of heat carrier. The invention is not restricted, either, to the location shown of the heat exchanger, which, of course, also can be positioned beneath the water surface.

I claim:

1. A method of recovering thermal energy from sea water and comparable water masses, characterized in that sea water is supplied at a constant or variable flow from a place of suitable choice in respect of the temperature conditions in the water mass to a heat exchanger (3) and returned to the sea, that a heat carrying medium is pumped through the heat exchanger (3) and a supply conduit (7,11) to an evaporator of a per se known heat pump (8) and through a return conduit (12,9) again to the heat exchanger (3), and the medium is pumped with a flow exceeding the medium flow through the evaporator, that a part of the medium is directed from the supply conduit (7) past (10) the evaporator and to the return conduit (9), and that the flow of the sea water is of a size at least equal to the medium flow.

2. A method as defined in claim 1, characterized in that the part of the medium is directed adjustably from the supply conduit (7) past the evaporator to the return conduit (9) by means of a shunt valve.

3. A method as defined in claim 1, characterized in that the part of the medium is directed adjustably from the supply conduit (7) past the evaporator to the return conduit (9) by means of a pump in the conduit (7) between the evaporator and the by-pass of the medium past the same.

* * * * *